US005531191A

United States Patent [19]

Davis

[11] Patent Number: 5,531,191

[45] Date of Patent: Jul. 2, 1996

[54] FLUID TEMPERATURE MONITOR

[75] Inventor: William J. Davis, Columbus, Ohio

[73] Assignee: Thermo-Tech, Inc., Hilliard, Ohio

[21] Appl. No.: 525,483

[22] Filed: Sep. 8, 1995

[51] Int. Cl.[6] ..... F02B 77/00

[52] U.S. Cl. ..... 123/41.15; 123/198 D

[58] Field of Search ..... 123/41.15, 198 D, 123/198 DC

[56] References Cited

U.S. PATENT DOCUMENTS

| | | | |
|---|---|---|---|
| 2,389,103 | 11/1945 | Wood | 177/311 |
| 3,442,260 | 5/1969 | Exline et al. | 123/198 |
| 3,893,108 | 7/1975 | McBride, Jr. et al. | 340/420 |
| 4,106,470 | 8/1978 | San Sebastian Saizar | 123/198 DB |
| 4,147,151 | 4/1979 | Wright | 123/198 DC |
| 4,381,744 | 5/1983 | Terry | 123/198 DC |
| 4,463,800 | 8/1984 | Hadden | 165/11 R |
| 4,557,224 | 12/1985 | DuBois | 123/41.15 |
| 4,653,445 | 3/1987 | Book et al. | 123/198 DC |
| 4,672,920 | 6/1987 | Duprez | 123/41.15 |
| 4,930,466 | 6/1990 | Osborne, Jr. | 123/179 BG |
| 4,942,849 | 7/1990 | Shelton | 123/41.1 |

*Primary Examiner*—Noah P. Kamen
*Attorney, Agent, or Firm*—John L. Gray

[57] ABSTRACT

A fluid temperature monitor comprising a thermosensing unit which is of a size and shape so that it may be readily inserted between the male exit from the fluid coolant pump and the radiator hose connected thereto, thus permitting universal installation in internal combustion engines.

2 Claims, 1 Drawing Sheet

FLUID TEMPERATURE MONITOR

BACKGROUND OF THE INVENTION

The present invention relates to a fluid temperature monitor, and more particularly, to a monitor for monitoring the overheating condition of the coolant fluid of an internal combustion engine, thereby preventing damage to the engine. This invention is especially designed so that it may be installed with a minimum of effort in existing internal combustion engines.

Devices of this general type have been in existence for some time. Examples are U.S. Pat. No. 4,381,744 Terry, and U.S. Pat. No. 3,893,108, McBride, et al., which not only monitors the coolant fluid temperature but the oil pressure sensors in the internal combustion engine. U.S. Pat. No. 4,147,151, Wright and U.S. Pat. No. 4,381,744, Terry both provide a delay between the warning signal and the initial cut-off of the engine. Also pertinent are U.S. Pat. No. 2,389,103, Wood, U.S. Pat. No. 4,653,445 Book, et al., and U.S. Pat. No. 4,930,466 Osborne, Jr. All of these examples of prior art in this area require special fittings in order to attach the system to the container of the coolant fluid so that its temperature may be monitored. This is expensive and often involves mounting threaded openings and thus there is not a fluid temperature monitor in the prior art which is a universally adaptable unit for mounting in the coolant fluid of an internal combustion engine.

SUMMARY OF THE INVENTION

The present invention uses a thermosensing element which may be readily inserted into the coolant fluid in an internal combustion engine and is of a size and shape so that a leak proof connection where the thermosensing unit is inserted may be realized. The thermosensing unit then is coupled to a device which will audibly and visibly warn the driver of the temperature of the coolant fluid exceeding a predetermined level and will kill the engine ignition thus disabling the vehicle. The visible warning signal will remain activated as long as the temperature is above a pre-selected value and when the temperature has returned to an acceptable level the visible warning signal will be deactivated and the ignition will be reconnected and the engine may be restarted.

It is therefore an object of this invention to provide a fluid temperature monitor for monitoring the temperature of the coolant fluid of an internal combustion engine where the thermosensing means is universally adaptable to most any liquid cooled internal combustion engine.

It is a further object of this invention to provide a fluid temperature monitor that will audibly warn when the temperature of the coolant fluid exceeds a certain acceptable value and then will automatically deactivate the ignition of the internal combustion engine and provide a visual signal as long as the ignition is deactivated.

It is still a further object of this invention to provide such a fluid temperature monitor which will automatically reactivate the ignition system of the internal combustion engine when the coolant fluid temperature decreases to an acceptable level and wherein the visual warning signal will also be deactivated.

These, together with other objects and advantages of the invention will become more readily apparent to those skilled in the art when the following general statements and descriptions are read in light of the appended drawings.

DETAILED DESCRIPTION OF THE INVENTION

Figure 1:
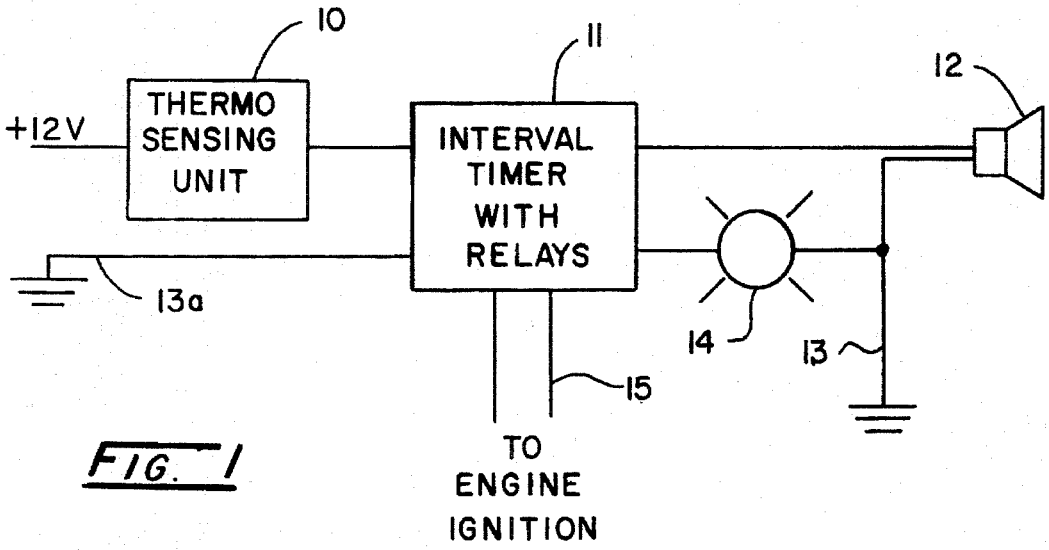
FIG. 1 is a schematic outline of the electrical circuit of the invention.

Refereeing first to FIG. 1, the thermosensing unit shown generally at 10 is connected to the 12 volt electrical system in the vehicle. The thermosensing unit is also connected to the interval timer with relays 11 which in turn is connected to the audible unit 12 which is connected to ground 13. The interval timer with relays 11 is connected to ground at **13*a* and is also connected to a visible display unit 14 and is also connected to the engine ignition shown at 15. The interval timer with relays 11** and the various elements associated therewith are stock, off the shelf, items readily available and may be easily assembled by a person skilled in the art.

Figure 2:
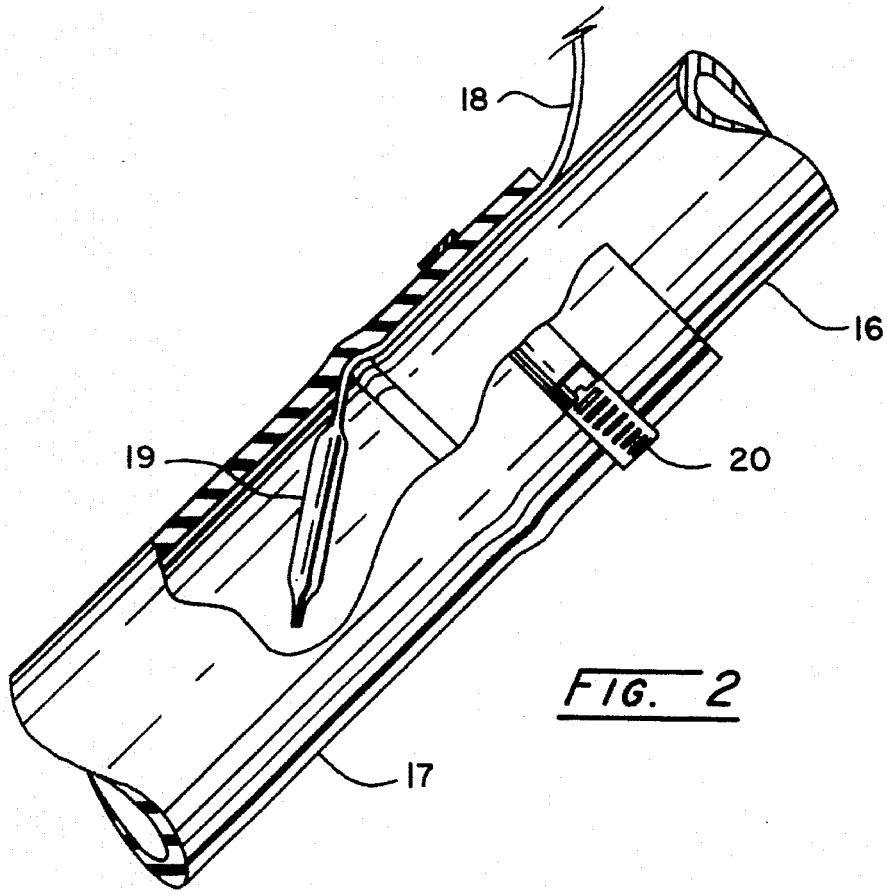
FIG. 2 is a side elevation view partly in section of the connection between the pipe extending from the cooling fluid pump and the radiator hose showing the temperature sensing unit positioned therein.

Referring now more particularly to FIG. 2 the water pump male discharge in the form of a pipe fitting is shown at 16 positioned within the radiator hose 17 and inserted between these two elements is the thermosensing unit 10 having an output in the form of a flattened tubular conduit 18 terminating in a capillary bulb 19. A conventional worm type hose clamp 20 surrounds the radiator hose 17 and the pump discharge 16 and the flattened tubular conduit 18.

In operation the capillary bulb 19 of the thermosensing unit 10 is inserted in the fluid coolant as shown in FIG. 2 and the flattened tubular conduit 18 is connected to the interval timer with relays 11. When the fluid coolant reaches a specific temperature the thermosensing unit 10 will actuate a first relay in the interval timer with relays 11 which activates the audible alarm 12. After a preset period of time a second relay in the interval timer and relays 11 will be actuated which will cause the visible display unit 14 to be actuated and the engine ignition 15 to be switched off and the audible alarm 12 to be deactivated.

The audible alarm 12 provides the operator of the vehicle containing the internal combustion engine an opportunity to pull over to the side of the road and stop the vehicle.

After the temperature of the coolant has reached a certain lower safe level the visible display unit 14 will be turned off, the engine ignition 15 will be reactivated by the second relay in the interval timer with relays 11 and it will be possible to restart the vehicle.

While this invention has been described in its preferred embodiment, it is to be appreciated that variations therefrom may be made without departing from the true scope and spirit of the invention.

What is claimed is:

1. A monitor for monitoring the temperature of the coolant fluid of an internal combustion engine provided with a radiator and a pump connected between said internal combustion engine and said radiator for circulating said coolant fluid between said internal combustion engine and said radiator and comprising:

thermosensing means having output means, and adapted to function within a radiator hose and adapted to extend between said hose and a pipe fitting it attaches to with a fluid tight joint, audible warning means, first relay means which is responsive to said output means to close and complete an electrical circuit to actuate said audible warning means for a preset period of time when the temperature of said fluid reaches a predetermined level, internal combustion engine cutoff means, visible display means, second relay means which is responsive to said output means to close and complete an electrical circuit to activate said visible display means and said internal combustion engine cutoff means after said preset period of time.

2. The monitor of claim 1 wherein said thermosensing means comprises a capillary bulb adapted to be positioned in the coolant fluid and said output means is a flattened tube which fits between said hose and said pipe so as to enable a leak-free joint to be maintained between said pipe and said hose.

* * * * *